US006952861B2

(12) United States Patent
Ynosencio

(10) Patent No.: US 6,952,861 B2
(45) Date of Patent: Oct. 11, 2005

(54) MULTIPLE AXIS CONTINUOUS HINGE SYSTEM

(75) Inventor: Manuel Ynosencio, P.O. Box 9616, Austin, TX (US) 78766

(73) Assignee: Manuel Ynosencio, Austin, TX (US)

( * ) Notice: Subject to any disclaimer, the term of this patent is extended or adjusted under 35 U.S.C. 154(b) by 11 days.

(21) Appl. No.: 10/286,094

(22) Filed: Nov. 1, 2002

(65) Prior Publication Data

US 2004/0200037 A1 Oct. 14, 2004

(51) Int. Cl.[7] ..... E05D 3/06

(52) U.S. Cl. ..... 16/366; 16/369; 16/354; 16/225; 16/382

(58) Field of Search ..... 16/366, 368, 369, 16/302, 354, 225, 382; 160/187, 199, 206, 229.1, 235, 231.2

(56) References Cited

U.S. PATENT DOCUMENTS 110,659 A * 1/1871 Jenness ..... 16/366
368,539 A * 8/1887 LUdlow ..... 16/366
4,777,777 A * 10/1988 Massimo ..... 52/586.2
4,928,350 A * 5/1990 Morgan ..... 16/297
4,995,144 A * 2/1991 Gateley ..... 16/261
5,493,760 A * 2/1996 Takimoto ..... 16/366
5,659,929 A * 8/1997 Cheng ..... 16/366
5,943,739 A * 8/1999 Vandergriff ..... 16/366
6,098,247 A * 8/2000 Santelli, Jr. ..... 16/225

* cited by examiner

*Primary Examiner*—Chuck Y. Mah

(57) ABSTRACT

This invention combines the woodworking industry with the mechanical hinge industry to result in a novel hinge system primarily for use in the woodworking industry. The present invention also has applications in other industries where hinge systems are used. A multiple axis continuous hinge system allows a door or lid to which it is attached to open or rotate up to 360 degrees. The invention is a viable alternative for any conventional hinge. It is simple to apply. The invention is an aesthetically pleasing alternative for any conventional hinge and because of its great strength and flexibility it has applications that are offered by no other hinge. This hinge system lends itself to production and also offers the wood industry greater yield because of the value-added to its small parts which may be produced from off-fall and lower grades of lumber which would otherwise be scrap.

12 Claims, 13 Drawing Sheets

MULTIPLE AXIS CONTINUOUS HINGE SYSTEM

BACKGROUND OF THE INVENTION

1. Field of the Invention

The present invention relates to a multiple axis continuous hinge system for use in connection with allowing up to and including a 360 degrees rotation of an object to which this hinge system is attached. The multiple axis continuous hinge system has particular utility in connection with replacing a conventional hinge in the woodworking industry.

SUMMARY OF THE INVENTION

The present invention essentially comprises a multiple axis continuous hinge system comprising one or more segment with a first side having a first edge. The segment also has a second side having a second edge. The second edge has a full radius. The segment comprises at least one lengthwise hollow section with a tongue coupled to the segment. A member is applied to the segment, having a receiving section operative to fit the tongue on the segment. The invention comprises a block having two lengthwise hollow sections and two ends having a full radius. There are also rods present that connect the segments and blocks.

There has thus been outlined, rather broadly, the more important features of the invention in order that the detailed description thereof that follows may be better understood and in order that the present contribution to the art may be better appreciated.

There are, of course, additional features of the invention that will be described hereinafter and which will form the subject matter of the claims attached.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is an object of the present invention to provide a new and improved multiple axis continuous hinge system that may be easily and efficiently manufactured and marketed.

An even further object of the present invention is to provide a new and improved multiple axis continuous hinge system that has a low cost of manufacture with regard to both materials and labor, and which accordingly is then susceptible of low prices of sale to the consuming public, thereby making such multiple axis continuous hinge system economically available to the buying public.

Still another object of the present invention is to provide a new multiple axis continuous hinge system that provides in the apparatuses and methods of the prior art some of the advantages thereof, while simultaneously overcoming some of the disadvantages normally associated therewith.

Even still another object of the present invention is to provide a multiple axis continuous hinge system for replacing a conventional hinge in the woodworking industry. This allows up to and including a 360 degrees rotation of an object to which this hinge system is attached These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DESCRIPTION OF THE PREFERRED EMBODIMENT

Figure 1:
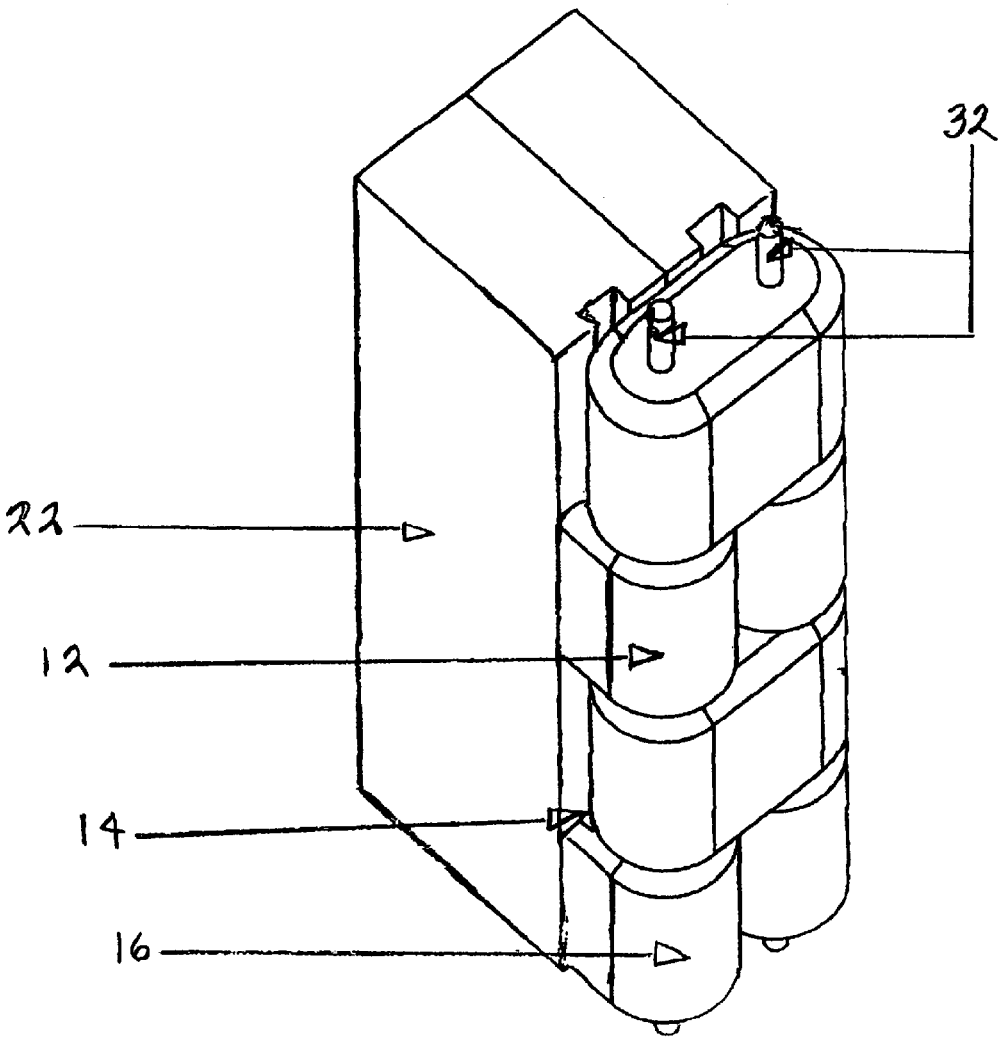
FIG. 1 is an overview of the preferred embodiment of the multiple axis continuous hinge system constructed in accordance with the principles of the present invention.

Referring now to the drawings, and particularly to FIGS. 1–14, a preferred embodiment of the multiple axis continuous hinge system of the present invention is shown and generally designated by the reference numeral 10.

Figure 2:
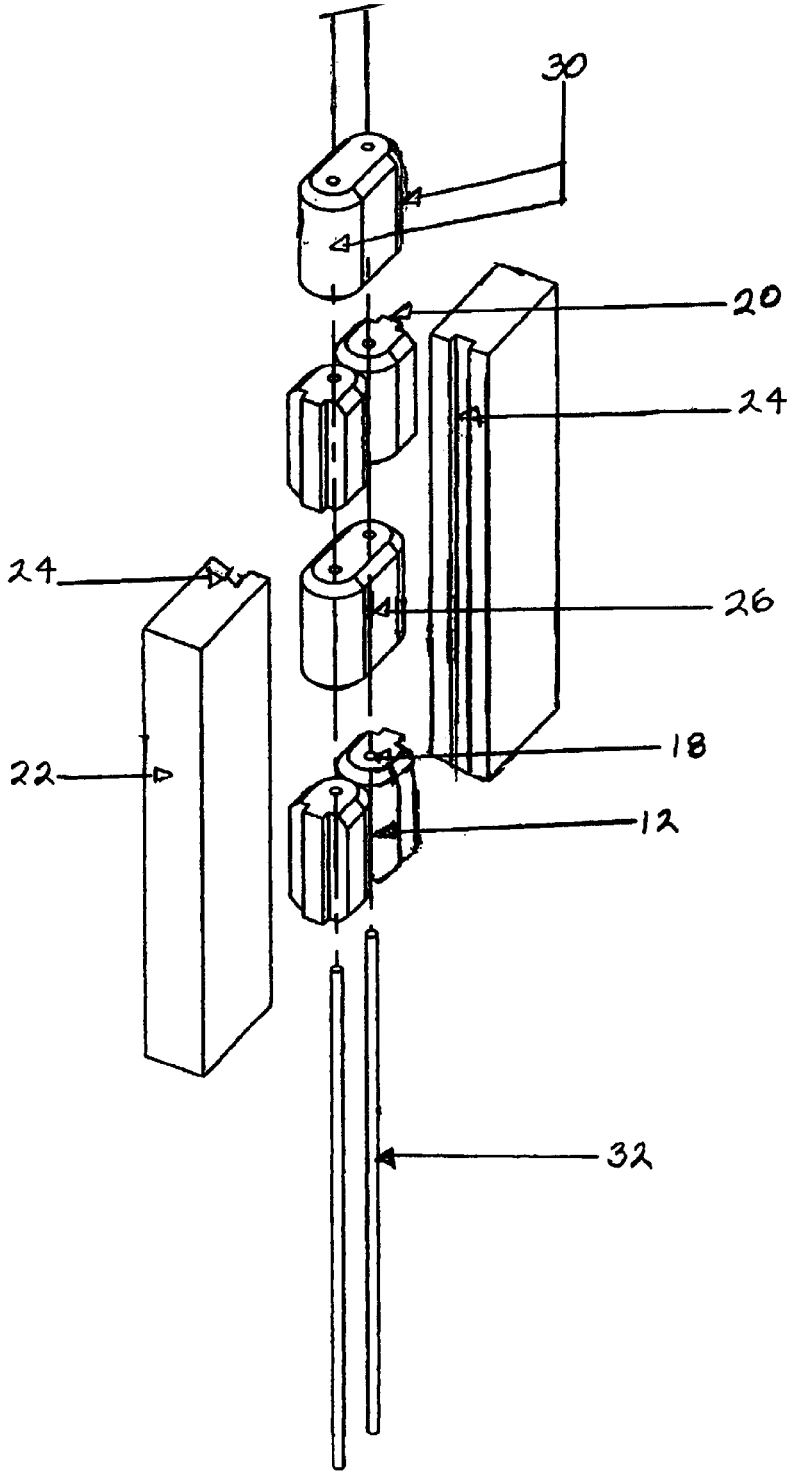
FIG. 2 is a side view of the multiple axis continuous hinge system of the present invention.

In FIGS. 1 and 2, a new and improved multiple axis continuous hinge system 10 of the present invention for allowing up to and including a 360 degrees rotation of an object to which this hinge system is attached is illustrated and will be described. More particularly, the multiple axis continuous hinge system 10 has a multiple axis continuous hinge system comprising at least two segments 12 with a first edge 14 and a second edge 16. The second edge 16 is rounded over with a radius equal to one half the thickness of the segment 12. The second edge of the segment 12 can also be beveled with a radius equal to one half the thickness of the segment. The segments 12 also have a lengthwise hollow section 18. In use, the segments 12 are separated by a block 26.

Figure 3:
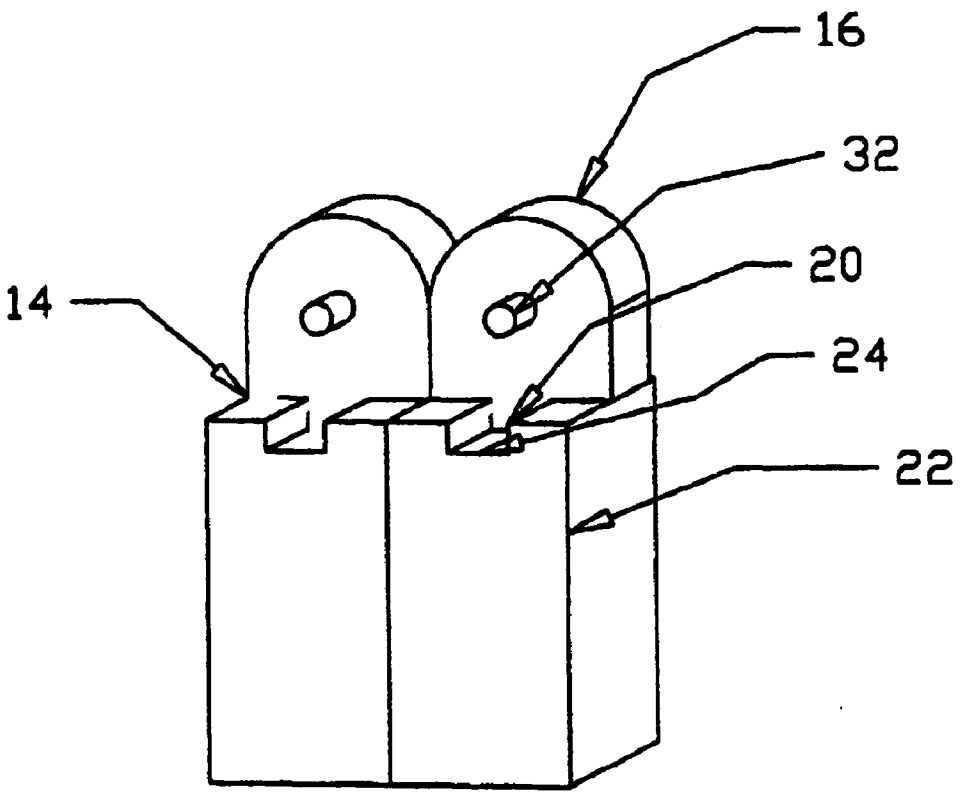
FIG. 3 is a front view of the multiple axis continuous hinge system of the present invention.

FIG. 3 shows a tongue 20 coupled to the segment 12 and a member 22, applied to the segment 12, having a receiving section 24 operative to fit the tongue 20.

Figure 4:
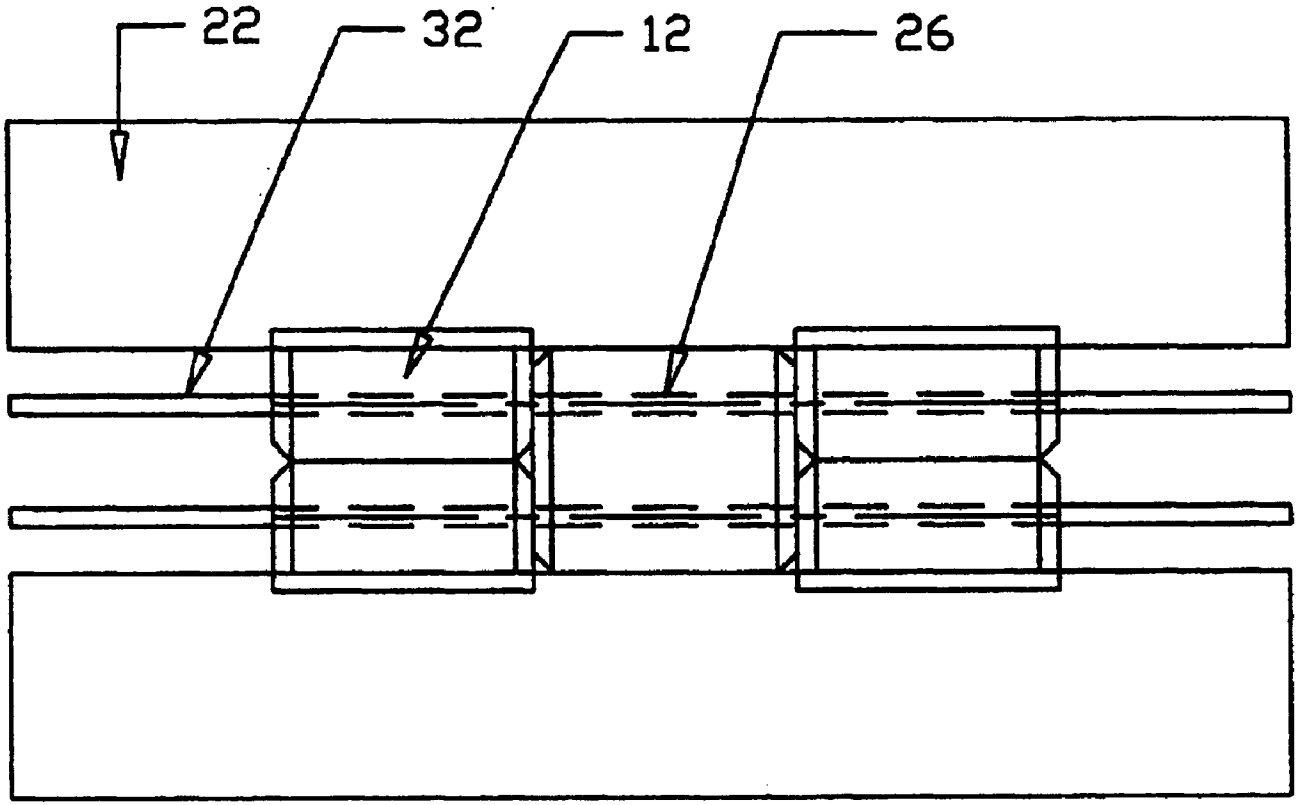
FIG. 4 is a overview of an opened position of the multiple axis continuous hinge system of the present invention.

FIG. 4 shows an overview of the present invention in an opened position. In FIGS. 1, 2 and 4, a block 26 is shown between the two sets of two segments 12 with two rods 32 inserted through the lengthwise hollow sections 18 of the segments 12 and the lengthwise hollow section 28 of the block 26. The rods can be made of either metal, plastic or wood.

Figure 5:
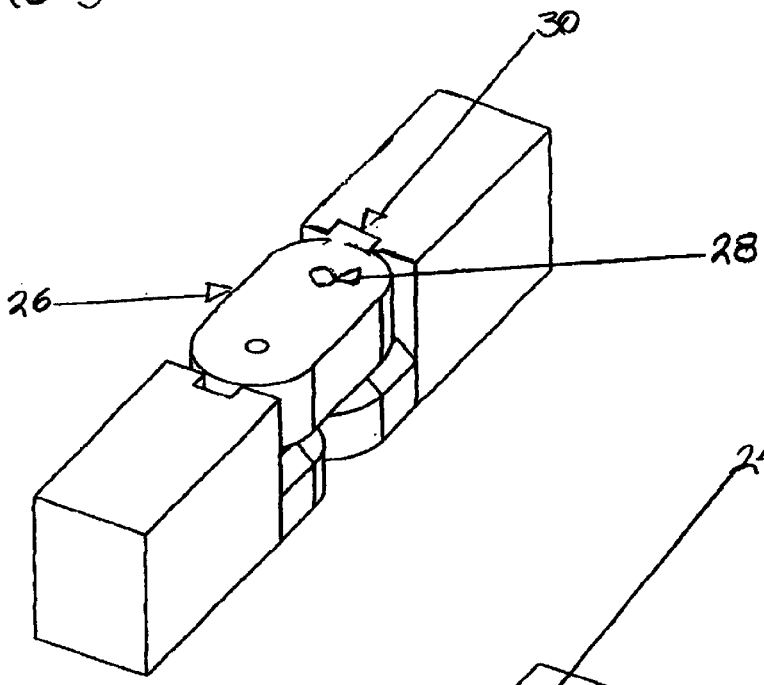
FIG. 5 is an overview of the end of a block component of the multiple axis continuous hinge system of the present invention.

FIG. 5 shows an overview of the end of a block 26, which has two edges 30 rounded over with a radius equal to one half the thickness of the segment 12, and two lengthwise hollow sections 28. The block 26 can be made of either metal, plastic, stone or wood.

Figure 6:
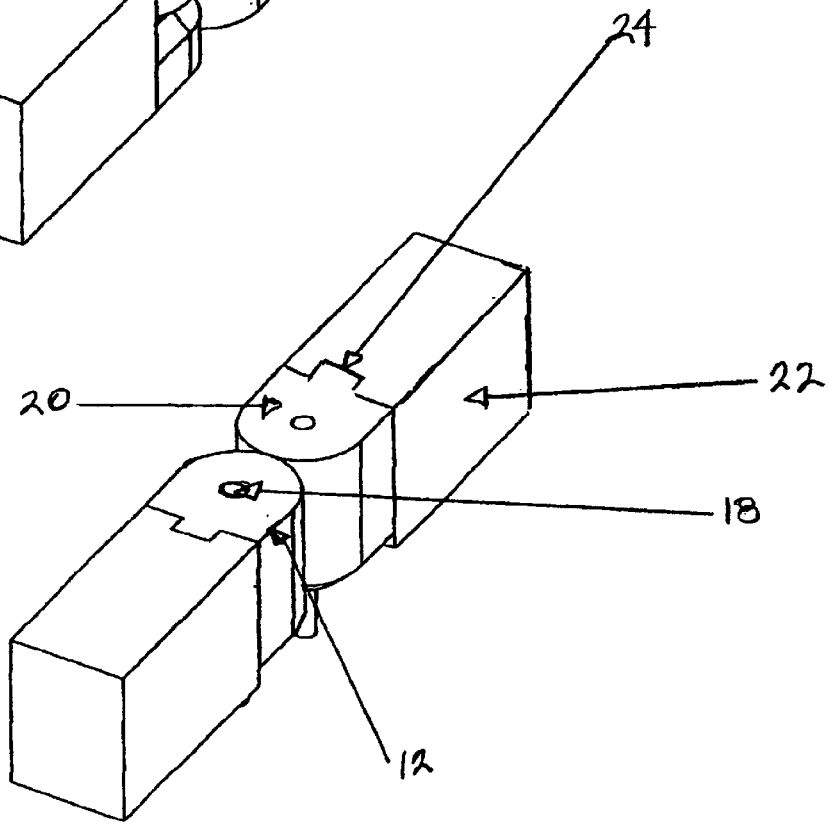
FIG. 6 is an overview of the end of a segment component of the multiple axis continuous hinge system of the present invention.

FIG. 6 shows an overview of an end of a segment 12 which has one lengthwise hollow section 18, and a tongue 20 operative to fit inside a receiving section 24 of a member 22 to be hinged. The segment can be made of either wood, stone, metal or plastic.

Figure 7:
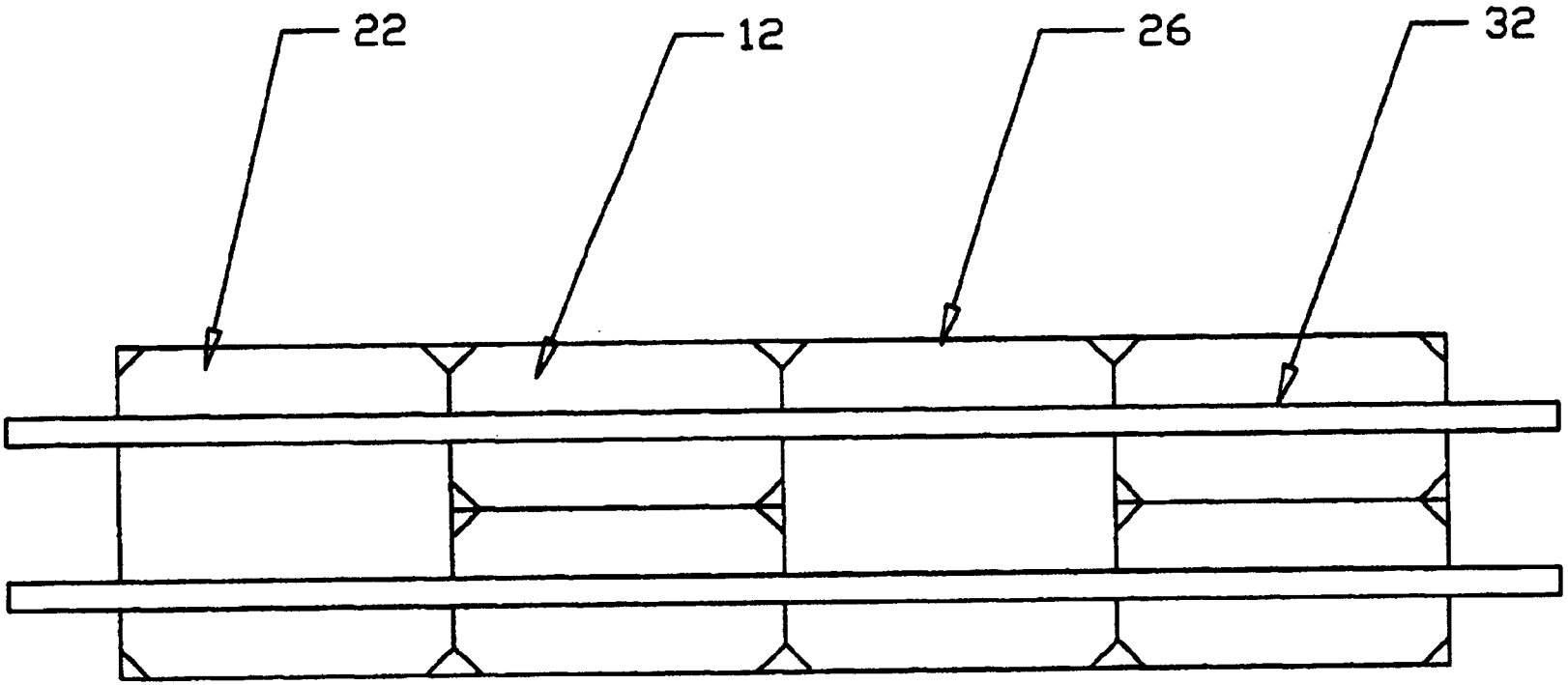
FIG. 7 is an overview of a dissection of the multiple axis continuous hinge system of the present invention.
Figure 8:
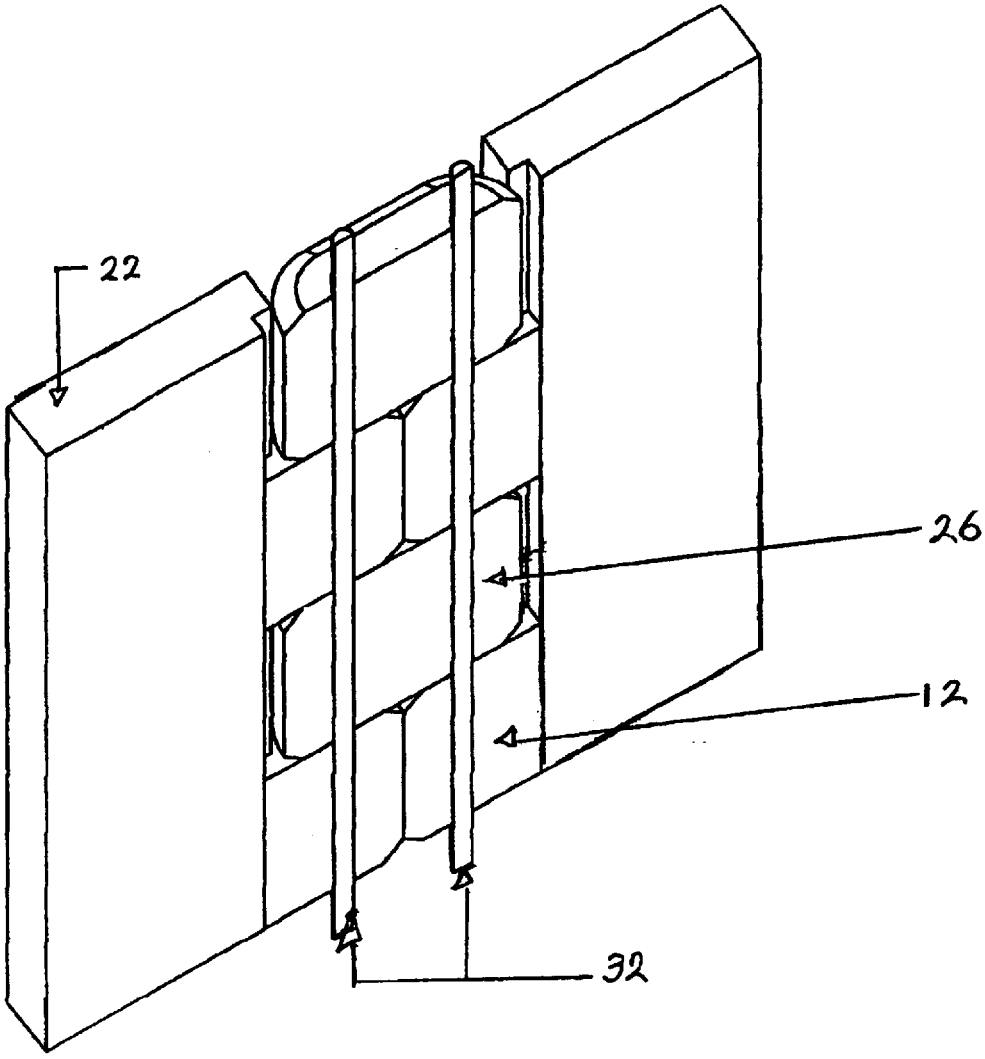
FIG. 8 is a side view of a dissection of the multiple axis continuous hinge system of the present invention.

FIG. 7 is an overview and FIG. 8 is a side view of a dissected version of the present invention, which show how the rods 32 are inserted through the lengthwise hollow section 18 of the segments 12 and the lengthwise hollow sections 28 of the block 26.

Figure 9:
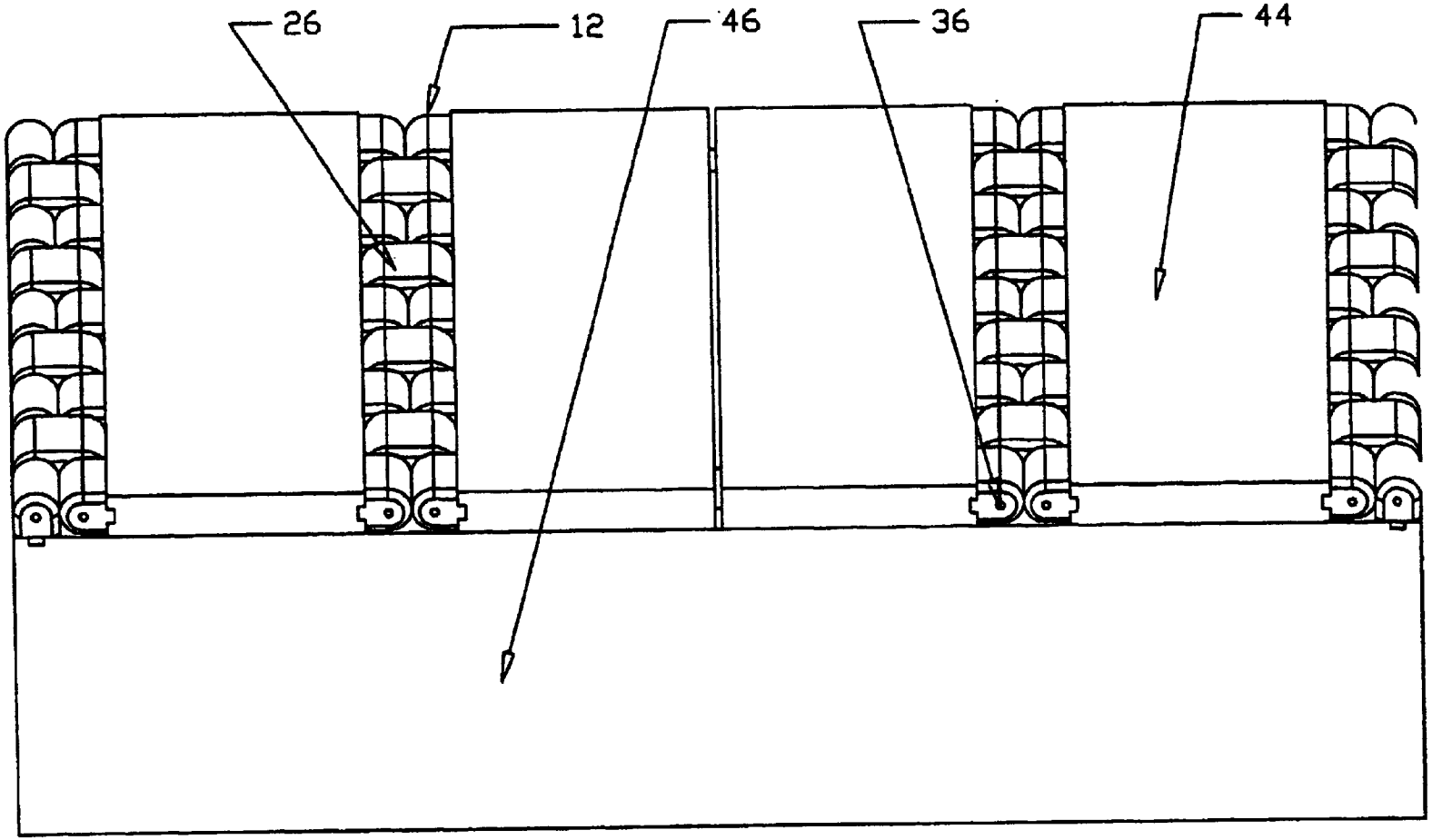
FIG. 9 is front view of a box which comprises the multiple axis continuous hinge system of the present invention.

FIG. 9 is a front view of a box 46 comprising the multiple axis continuous hinge system of the present invention. FIG. 9 shows how a segment 12 is attached to a first member 22 and fastened opposite another segment 12 attached to a second member 34 to be hinged. In FIG. 9, the first member 22 is a lid 44 and the second member 34 is a box 46. The first member can also be the side of a box, a panel of a screen, or a door. In FIG. 9, the rods 32 are inserted through the hollow sections 18 of the segments 12 and the block 26 are held in place at both ends 42 of the rods 32 by a plug 36 inserted in the segments 12 at the segment ends 38.

Figure 10:
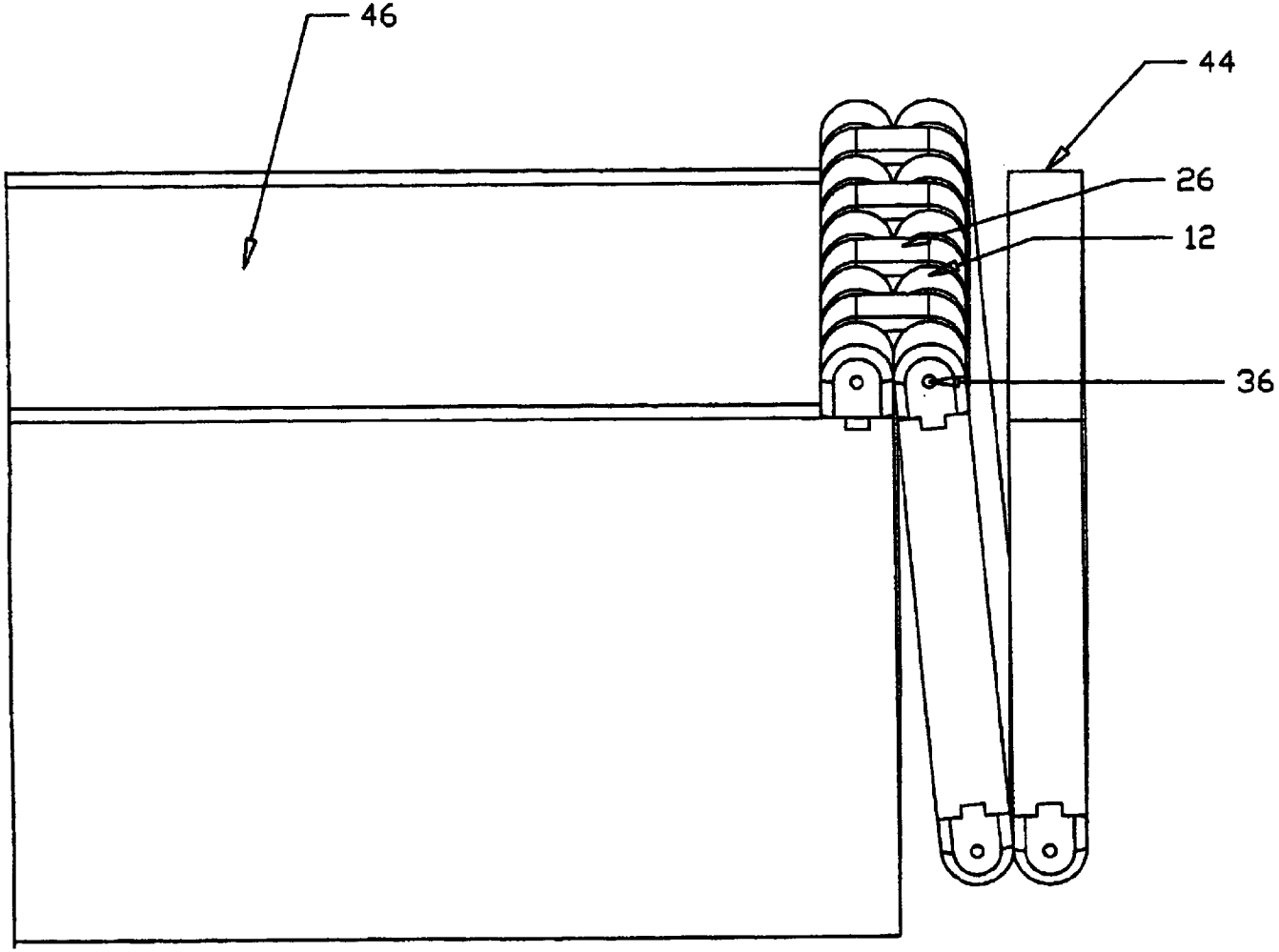
FIG. 10 is front view of a box with an opened lid which comprises the multiple axis continuous hinge system of the present invention.

FIG. 10 is a front view of the same box 46 as in FIG. 9, but with an open lid 44. FIG. 10 illustrates the 360 degrees rotation ability of the present invention.

Figure 11:
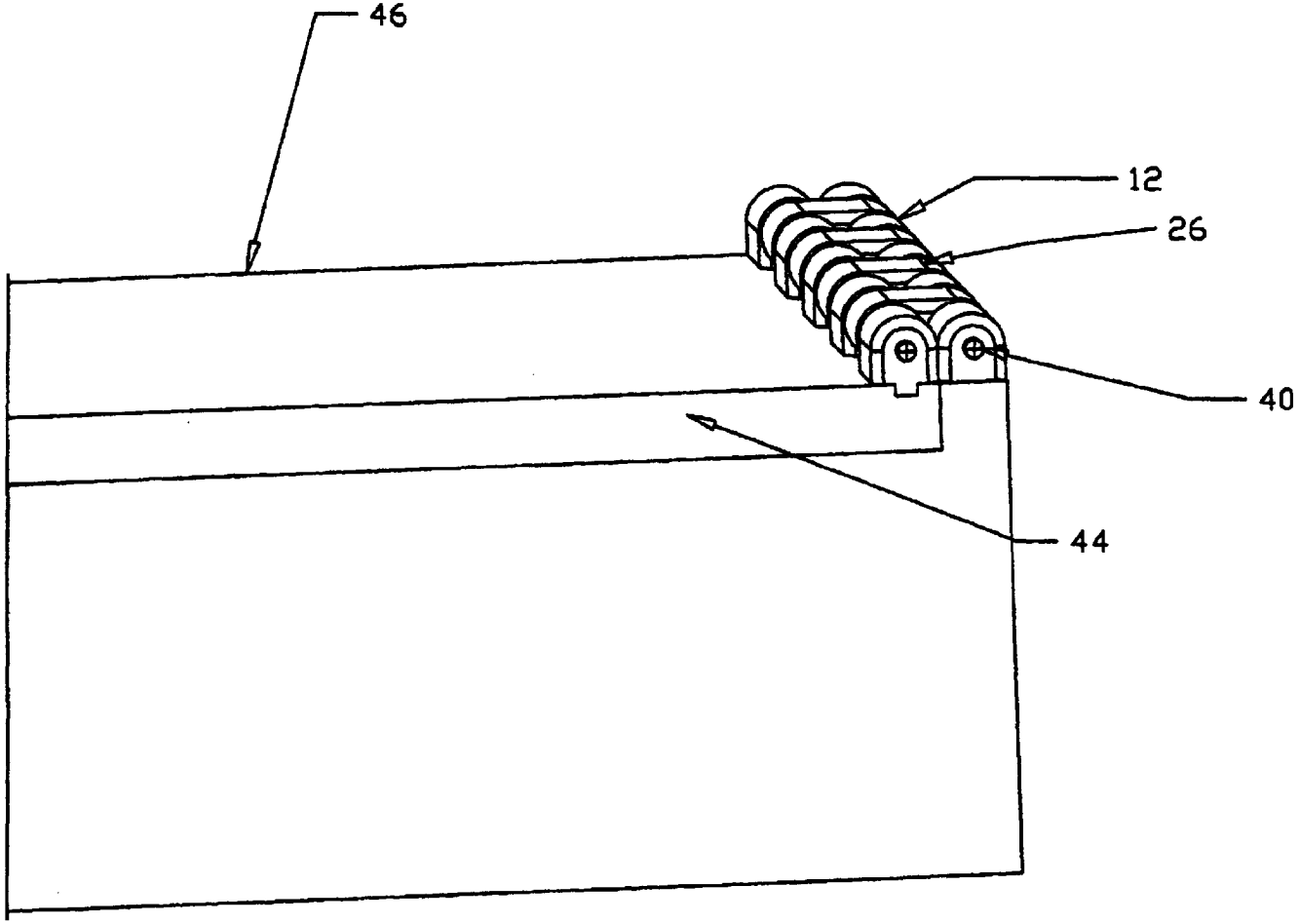
FIG. 11 is a front view of a box which comprises the multiple axis continuous hinge system of the present invention.
Figure 12:
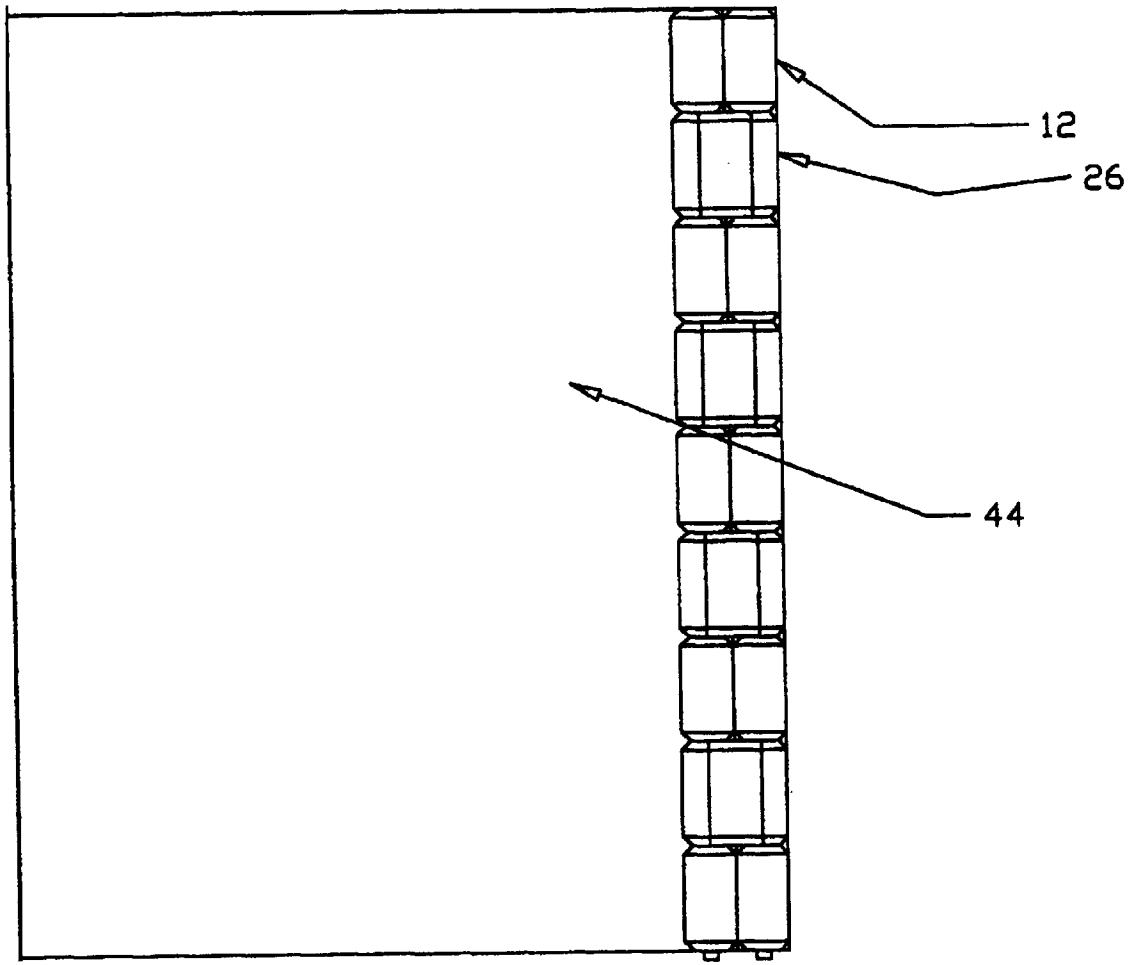
FIG. 12 is an overview of a box which comprises the multiple axis continuous hinge system of the present invention.

FIG. 11 is a front view and FIG. 12 is an overview of a box 46 wherein the rods 32 are secured at the rod ends 42 by a screw mechanism 40. The rod ends 42 can also be secured by a nut and bolt mechanism.

Figure 13:
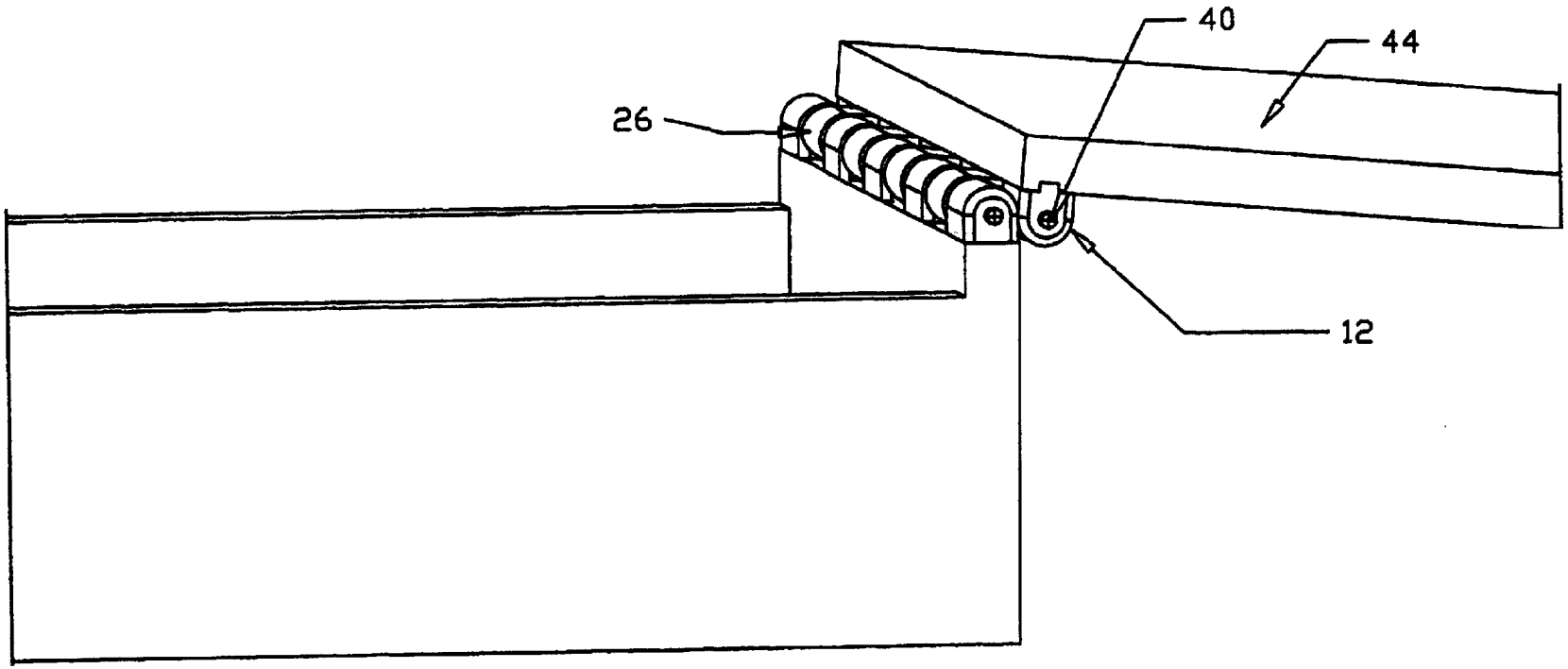
FIG. 13 is a front view of a box with an opened lid which comprises the multiple axis continuous hinge system of the present invention.

FIG. 13 is a side view of the box 46 shown in FIGS. 11 and 12 showing the opened lid of the box 46.

Figure 14:
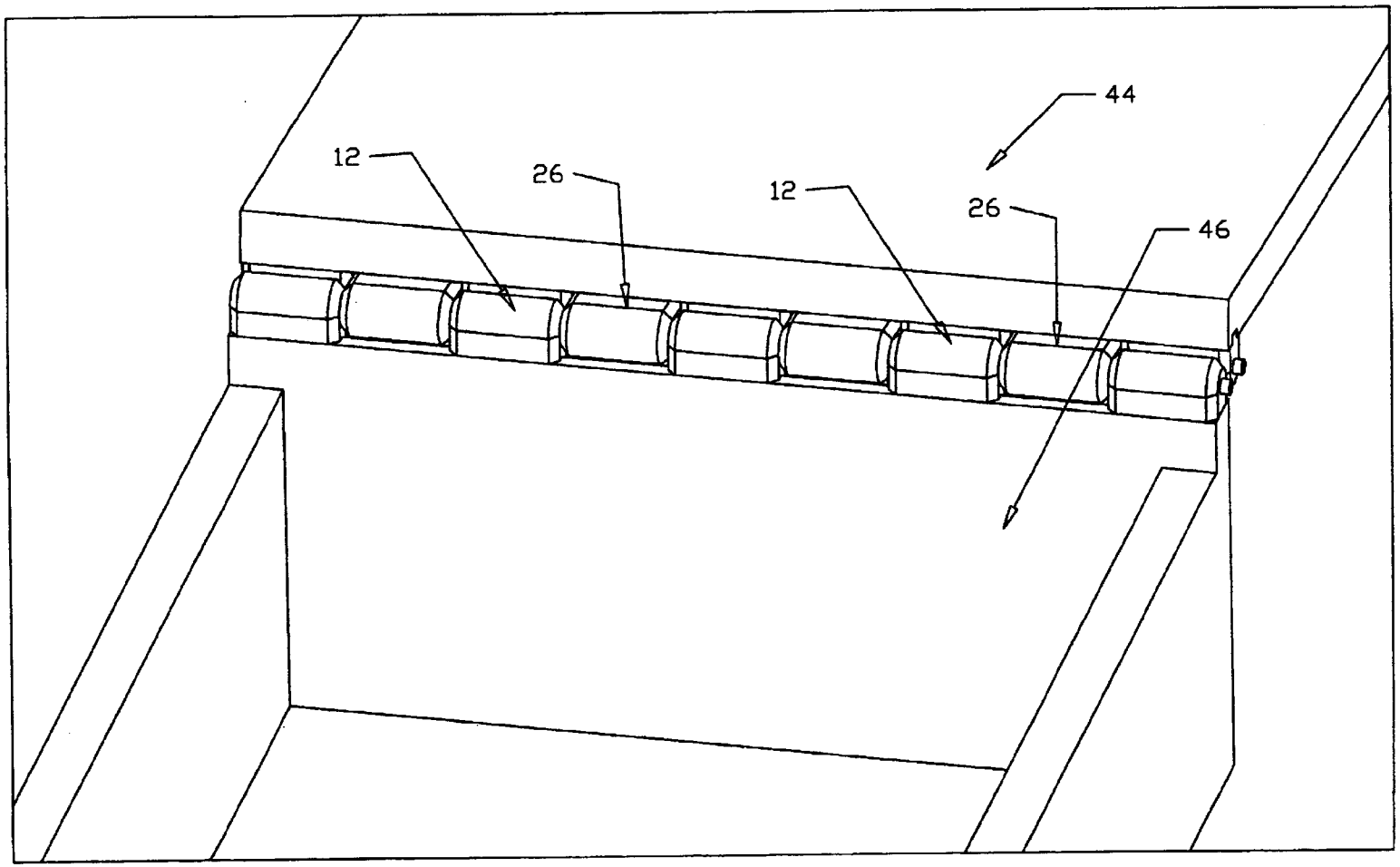
FIG. 14 is a front view of a box with an opened lid which comprises the multiple axis continuous hinge system of the present invention.

FIG. 14 is a front view of the present invention wherein three axis are shown with three rods 32 and alternating blocks 26 and segments 12. More variations and axis are possible than have been shown in the Figures described herein.

DICTATION OF DETAILED DESCRIPTION

While a preferred embodiment of the multiple axis continuous hinge system has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, any suitable sturdy material such as metal, plastic, cardboard, or glass may be used instead of the wood described. Also, the metal rod may be made of heavy-duty plastic, wood, or similar material. And although allowing up to and including a 360 degrees rotation of an object to which this hinge system is attached have been described, it should be appreciated that the multiple axis continuous hinge system herein described is also suitable for connecting a wide variety of lids and doors of all shapes or sizes.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A multiple axis continuous hinge system hinging a first member to a second member, comprising:

at least one pair of rectangular segments, each of which having a thickness and a width;

said segments each having a top side;

a bottom side;

a first edge and an opposite second edge extending between the top side and the bottom side;

the second edge of each said segment being rounded over with a radius equal to one half the thickness of one of said pair of segments at least one lengthwise hollow section extending through the top and bottom sides;

a tongue coupled to the first edge of each said segment;

each of said members having a receiving section respectively receiving the tongue of one of said at least two segments;

at least one rectangular block for pivotally connecting said pair of segments, said at least one block having a thickness, a width, a top and a bottom, two lengthwise hollow sections extending through the top and the bottom, and two opposite side edges being rounded over with a radius equal to one half the thickness of one of said pair of segments, said at least one block thickness being the same as the segments, and said at least one block width being twice the thickness; and two hinge pins, each of said pins respectively inserted through the hollow section of one of the segments and one of the hollow sections of the at least one block.

2. The multiple axis continuous hinge system of claim 1 wherein the at least one pair of segments comprises at least two pairs and the pairs are separated by the at least one block.

3. The multiple axis continuous hinge system of claim 2 wherein said at least one block and said segments are held in place at both ends of the pins by a plug inserted in the segments at the segments ends.

4. The multiple axis continuous hinge system of claim 1 wherein the pins are held in place at both ends of the pins by a nut and bolt mechanism.

5. The multiple axis continuous hinge system of claim 1 wherein the pins are held in place at both ends of the pins by a screw mechanism.

6. The multiple axis continuous hinge system of claim 1 wherein the first member is a lid of a box and the second member is a box.

7. The multiple axis continuous hinge system of claim 1 wherein the first member is a side of a box and the second member is a box.

8. The multiple axis continuous hinge system of claim 1 wherein the first member is a panel of a screen.

9. The multiple axis continuous hinge system of claim 1 wherein the first member is a door.

10. The multiple axis continuous hinge system of claim 1 wherein the segments are made of a material selected from the group consisting of wood, stone, metal, and plastic.

11. The multiple axis continuous hinge system of claim 1 wherein the at least one block is made of a material selected from the group consisting of metal, plastic, stone and wood.

12. The multiple axis continuous hinge system of claim 1 wherein the pins are made of a material selected from the group consisting of metal, plastic, and wood.

* * * * *